United States Patent [19]

Kosner

[11] Patent Number: 4,509,735

[45] Date of Patent: Apr. 9, 1985

[54] VARIABLE WIDTH ENVELOPE FEEDER

[75] Inventor: Jerry J. Kosner, LaGrange, Ill.

[73] Assignee: Bell & Howell Company, Chicago, Ill.

[21] Appl. No.: 401,577

[22] Filed: Jul. 26, 1982

[51] Int. Cl.[3] ..... B65H 5/08

[52] U.S. Cl. ..... 271/11; 271/93; 271/150; 271/31.1

[58] Field of Search ..... 271/11, 12, 13, 91, 271/93, 30 A, 94, 95, 96, 34, 35, 150, 276, 197, 154, 155, 263, 191, 152, 153

[56] References Cited

U.S. PATENT DOCUMENTS

| | | | |
|---|---|---|---|
| 2,639,150 | 5/1953 | Aberle | 271/155 |
| 3,171,647 | 3/1965 | Bishop | 271/11 |
| 3,219,339 | 11/1965 | Gutierrez | 271/11 |
| 3,894,732 | 7/1975 | Müller | 271/34 |
| 4,346,876 | 8/1982 | Guenther | 271/30 A |
| 4,369,959 | 1/1983 | Hornbuckle | 271/16 A |

*Primary Examiner*—Bruce H. Stoner, Jr.
*Assistant Examiner*—John A. Carroll
*Attorney, Agent, or Firm*—Neal C. Johnson; Alan H. Haggard; Howard B. Rockman

[57] ABSTRACT

A sheet feeding apparatus for feeding vertically disposed sheet material from a horizontally extending stack comprising a platform adapted to support a stack of sheet material, a vertically extending frame disposed at one end of the platform, and first and second rollers vertically supported in spaced relation by the frame. Endless webs extend around and are driven by the first and second rollers, wherein the webs include a plurality of perforations therein and have one run facing the platform. The one run has a portion which provides an effective contact surface to engage the first article in the stack of sheet material to transport the article from the stack of sheet material as the endless webs are driven. A carriage adjustably located between the first and second rollers supports third and fourth rollers, and the endless webs pass between the third and fourth rollers to continue movement in a different plane. Adjustment of the carriage establishes the effective contact surface of the webs to prevent corners of the sheet material from becoming caught by the perforations in the web. A vacuum force is applied to the face of the webs through the perforations and to enhance adhesion of the first article in the stack to the webs. Once removed from the stack, the sheet material is engaged by a nip roller and advanced to a work station.

13 Claims, 5 Drawing Figures

2
112
108
106
100
110
76
140
34
104
98
30
23
102
114
26
A
76
132
36
130
134
55
58
50B
52B
76
40
88
52A
82
96
86
52B
84
90
74
78
60
94
92
28
20
120
10
14
24
18
66
72
16
32
12
2

VARIABLE WIDTH ENVELOPE FEEDER

The present invention relates generally to a sheet material feeding apparatus and more particularly to a mechanism having a variable effective contact surface which engages and feeds sheet material such as envelopes into a document processing apparatus such as an imprinter.

BACKGROUND OF THE INVENTION

Several different types of document feeder devices are in common use in the prior art. These include belt or web type feeders, roll type feeders, and mechanical punch type feeders. Web type feeders exist which are designed to receive documents, such as individual envelopes which are standing vertically in a horizontally extending stack, and feeding the envelopes one at a time in a path perpendicular to the horizontal extent of the stack. In more efficient devices, the web which contacts the envelopes is normally perforated, and a vacuum force is applied to the face of the web which is in contact with the envelope. The vacuum force extends through the perforations in the web, and holds the first envelope in the stack in contact with the web as the web transports the envelope towards a work station.

Most sheet material processing devices such as envelope transporters can only be efficiently and economically designed to handle envelopes of different sizes which are processed at different times through the apparatus. However, present web feed devices include a movable web surface that is of a single length, and that length is necessarily fixed to handle the largest size envelope contemplated for use in the particular apparatus. In many such envelope feed devices, however, it has been found that the trailing corners of smaller envelopes become caught in the perforations of the web, which results in tearing or crumbling of the envelope, or causing more than one envelope from the stack to be engaged and transported by the web. When the feed web is initially designed to handle large sized business envelopes, but the apparatus is ultimately called upon to handle smaller envelopes, such as remittance envelopes, the smaller envelopes tend to get caught in the perforations, resulting in a malfunction of the feeder device, and ultimately causing jamming or other malfunctions of the apparatus in which the envelope is being fed for processing.

This defect in currently available web type envelope feeders has reduced the efficiency, workability, and commercial acceptance of prior art web type envelope feed devices. An object of the present invention, therefore, is to provide a novel web type envelope or sheet material feed device which comprises a feed web where the effective contact surface can be selectively varied to accommodate envelopes of different sizes without causing the corners of the envelopes to be caught in the perforations in the web.

A further object of the present invention is to provide a perforated web type sheet material feed device having a suction force applied through perforations in the web to engage and advance the sheet material to a work station as the web moves, wherein the effective contact surface of the web can be selectively varied to prevent the corners of the sheets from being caught by the perforations in the web.

Still another object of the present invention is to provide a web-type sheet material feed device wherein the pressure of the accumulated stack of sheet material bearing against the web is automatically controlled to permit the sheet material to be fed one at a time.

These and other objects and features accomplished by the present invention will be better understood with reference to the following summary of the invention, drawings, and detailed description thereof.

SUMMARY OF THE INVENTION

A sheet feeding apparatus is provided for feeding vertically disposed sheet material from a horizontal extending stack including a platform to support the stack of sheet material, a vertically extending frame disposed at one end of the platform having first and second rollers vertically supported in spaced relation by the frame, an endless perforated web extending around and driven by the first and second rollers and having one run facing the platform to provide an effective contact surface to engage the first article in the stack of sheet material to remove the first article from the stack, and adjusting means to vary the effective contact surface of the endless web, whereby the effective contact surface of the web is adjusted to prevent corners of the sheet material from becoming caught by the perforations in the web.

The sheet feeding apparatus also includes a plurality of belts in the platform which support the stack of sheet material and, when actuated, advance the stack of sheet material towards the effective contact surface of the endless web. Control means are provided to automatically regulate the advance of the stack of sheet material toward the effective contact surface of the web to maintain the proper pressure between the stack of sheet material and the web.

The present invention also provides a source of a vacuum force applied to the face of the effective contact surface of the endless web to cause adherence of the first article in the stack of sheet material with the effective contact surface of the web.

DETAILED DESCRIPTION OF THE DRAWINGS

Figure 1:
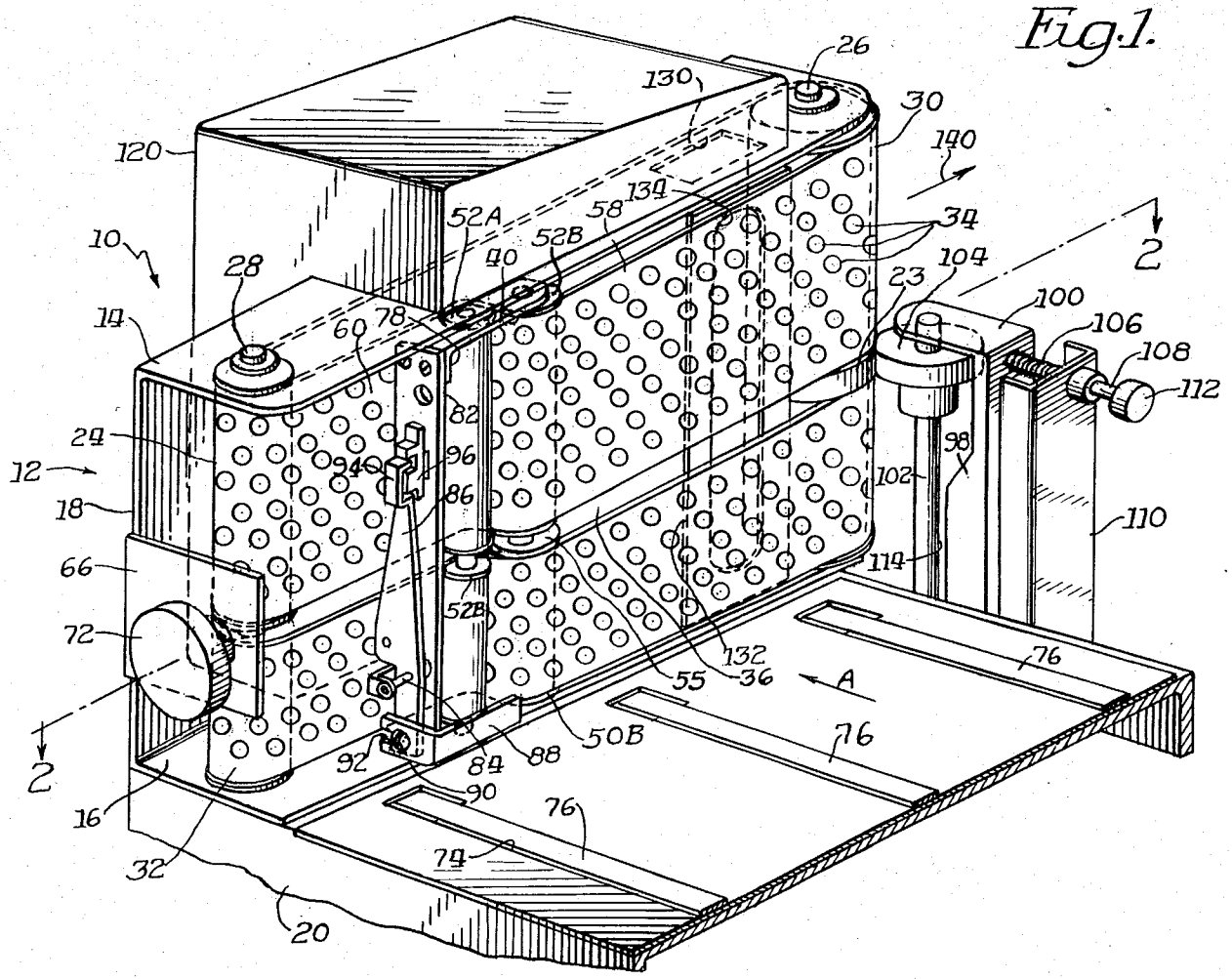
FIG. 1 is a front perspective view of a sheet feeding device constructed in accordance with the present invention, showing the variable length perforated web structure, and a portion of the platform for supporting the stacked sheets which are to be fed by the device.

Referring now to FIG. 1, a sheet feeding apparatus shown generally at 10 has a first frame 12 consisting of upper and lower portions 14, 16, and back portion 18. Frame 12 is rigidly mounted on and extends vertically from one end of horizontally extending platform 20.

A first roller element 22 and a second roller element 24 are mounted in spaced relation for rotation about shafts 26, 28 which extend between upper and lower frame portions 14, 16. Roller element 22 consists of two separate aligned roller sections 22A and 22B (FIG. 3) of equal diameter, with a space or gap between the two roller sections. Disposed in the space between sections 22A and 22B is a roller 23 on a one-way clutch which has a diameter slightly greater than the diameter of roller sections 22A and 22B. Roller element 24 also consists of two separate aligned roller sections 24A and 24B (FIG. 3), separated by a space or gap. For purposes to be explained, the outer diameter of roller element 22 is larger than the diameter of roller element 24.

A pair of endless web elements 30, 32 extend around roller elements 22, 24 and each web includes a plurality of perforations 34 extending therethrough. Web element 30 extends between roller sections 22A and 24A, and web element 32 extends between roller sections 22B and 24B. The two web elements 30, 32 are separated by a gap 36 (FIG. 1). Roller element 22 is rotated by suitable drive means (not shown) to cause endless webs 30, 32 to move across the face of frame 12 which opens in the direction of platform 20.

Figure 5:
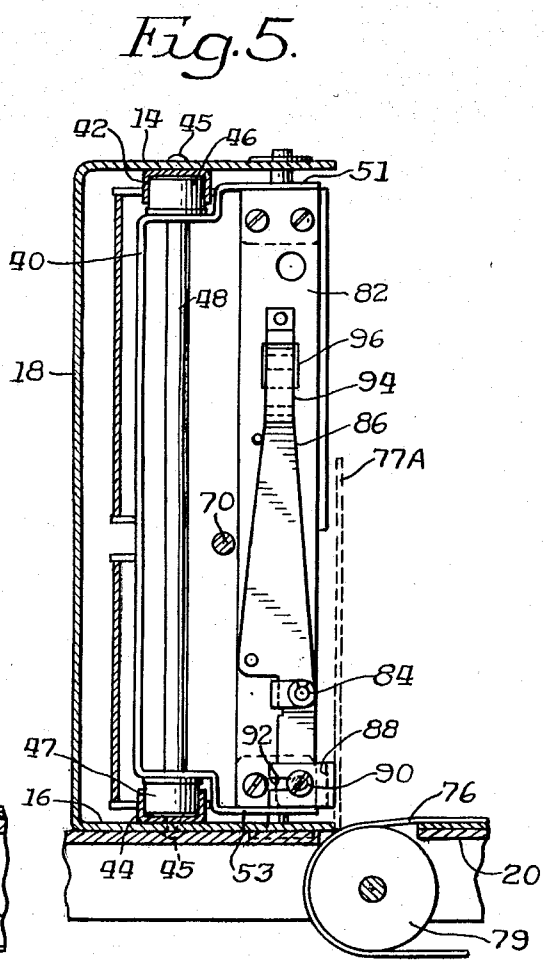
FIG. 5 is a vertical section of the sheet feeding apparatus taken along line 5—5 of FIG. 2, showing the details of the sheet pressure regulator switch and photocell system.

Referring to FIGS. 1, 2, 3, 4, and 5, a carriage 40 is slidably mounted for movement along generally U-shaped tracks 42, 44 which are secured on the inside surfaces of upper frame portion 14 and lower frame portion 16 by suitable fastening means 45 (FIG. 5). Carriage 40 includes a plurality of wheels 46, 47 mounted on both ends of shafts 48, 49, whereby wheels 46, 47 engage and ride in tracks 42, 44 (FIGS. 4, 5) as carriage 40 moves laterally, as viewed in FIG. 2.

Figure 4:
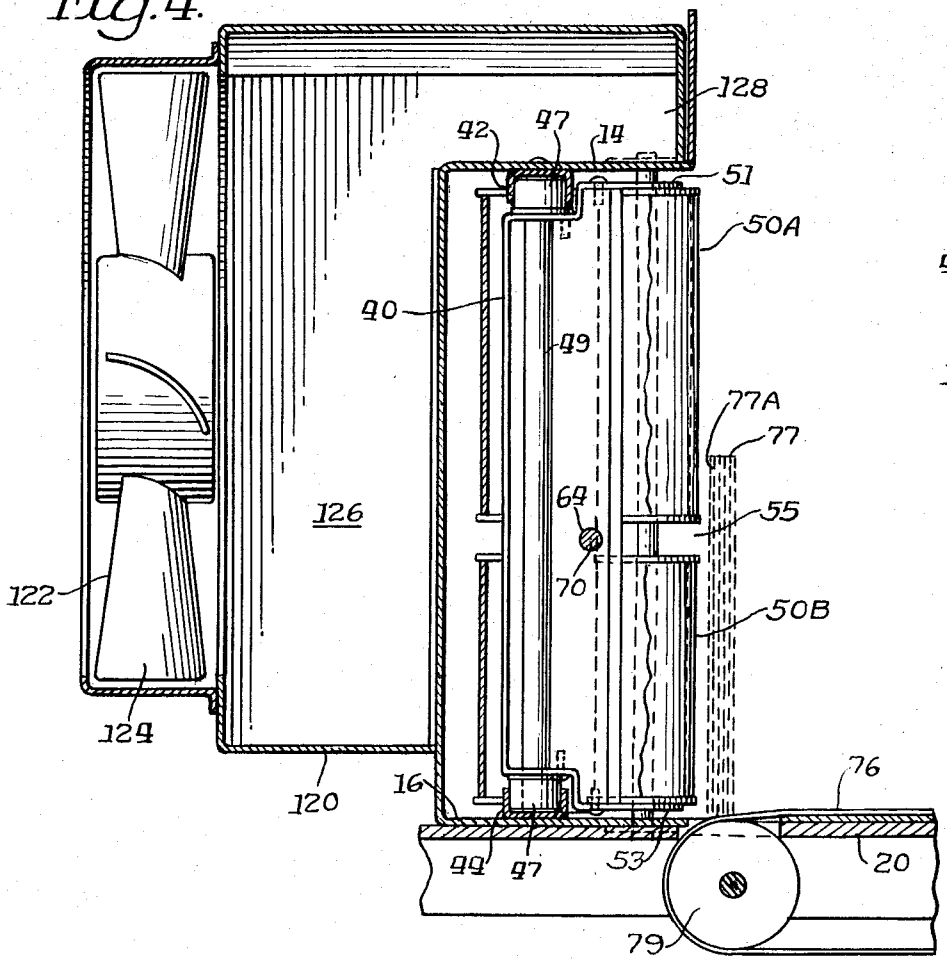
FIG. 4 is a cut-away side view of the sheet feeding apparatus taken along line 4—4 of FIG. 2, showing in particular the structure of the plenum system for providing the suction force to the web face.

Third and fourth roller elements 50, 52 are mounted for rotation about shafts 54, 56 which extend between end flanges 51, 53 of carriage 40. Each roller element 50, 52 includes an upper and lower section 50A, 50B, 52A, 52B (FIGS. 1, 4) to accommodate webs 30 and 32. Sections 50A and 50B, and sections 52A and 52B are separated by a gap 55 (FIG. 4).

Figure 2:
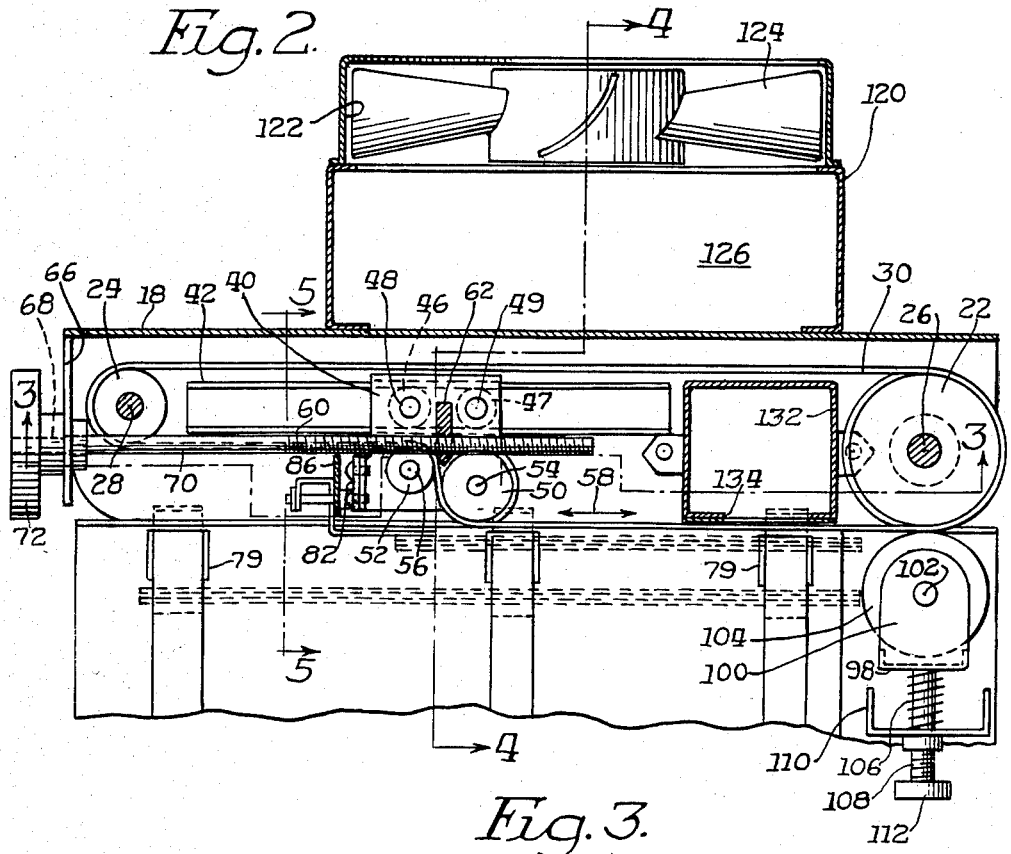
FIG. 2 is a cut-away top view of the sheet feeding apparatus of FIG. 1 taken along line 2—2 of FIG. 1, showing the web drive mechanism, the adjusting mechanism for the effective contact surface of the web, and the means for providing a suction force at the face of the perforated web.

As best seen in FIGS. 1 and 2, webs 30 and 32 pass between third roller 50 and fourth roller 52 whereby the plane of one of the runs of webs 30 and 32 is changed. Thus, the portion of webs 30, 32 which are adjacent platform 20 move in two separate but parallel planes 58 and 60. Plane 58 extends outwardly in the direction of platform 20, and provides an effective contact surface between webs 30, 32 and the first article 77A in the stack of sheet material 77 supported on platform 20. Plane 60 of webs 30, 32 extends away from platform 20.

Also, as viewed in FIGS. 1 and 2, plane 58 of the webs 30, 32 extends outward beyond the edges of upper frame portion 14 and lower frame portion 16, whereas plane 60 of webs 30, 32 extends beneath the edges of the respective frame portions 14, 16. As will be explained in further detail, the effective contact surface of webs 30, 32 consists of the portion extending in plane 58 which is positioned to transport sheet material from platform 20 one at a time to a processing apparatus, while no sheet material comes into contact with the portion of webs 30, 32 in plane 60. The diameters of rollers 22 and 24 are varied due to the change in plane of web movement caused by roller elements 50 and 52.

To adjust the position of carriage 40 and vary the length of the effective contact surface of webs 30, 32, carriage 40 includes a plate 62 extending between end flanges 51, 53 (FIG. 3), and an internally threaded aperture 64 is centrally disposed in plate 62. A flange 66 is attached to back frame portion 18, and includes an aperture 68 extending therethrough. Threaded rod 70 extends through aperture 68, and mates with the internal threads in aperture 64. A knob 72 is attached to threaded rod 70 adjacent flange 66, whereby threaded rod 70 can be rotated by turning knob 72. In the preferred embodiment, knob 72 is adapted for manual operation, however, threaded rod 70 can be power operated if desired.

Rotation of threaded rod 70 by means of knob 72 causes carriage 40 to move laterally, as viewed in FIGS. 1 and 2, and wheels 46 and 47 guide the movement of carriage 40 in U-shaped tracks 42, 44. The lateral position of roller elements 50, 52 is changed as carriage 40 moves under the influence of threaded rod 70. The length of webs 30, 32 extending in plane 58 is a function of the distance between roller elements 22 and roller elements 50. Upon movement of roller elements 50 away from roller elements 22, the length of webs 30, 32 in plane 58 becomes greater. Conversely, as roller elements 50 are positioned closer to roller elements 22, the length of webs 30, 32 in plane 58 decreases.

The upper surface of platform 20 includes a plurality of slots 74 extending longitudinally therein. Each slot contains a movable belt 76 which extends slightly above the surface of platform 20. Belts 76 extend around and are driven by rollers 79 (FIGS. 2, 4) such that the upper run of belts 76 move toward webs 30, 32. When activated, belts 76 are adapted to move a stack of vertically arranged sheets or documents such as envelopes 77 (FIG. 4) sitting on the belts 76 towards and into engagement with the effective contact surface of webs 30, 32 extending in plane 58. Belts 76 are driven in the direction A (FIG. 1) by suitable drive and control means (not shown) operably connected to rollers 79.

Figure 3:
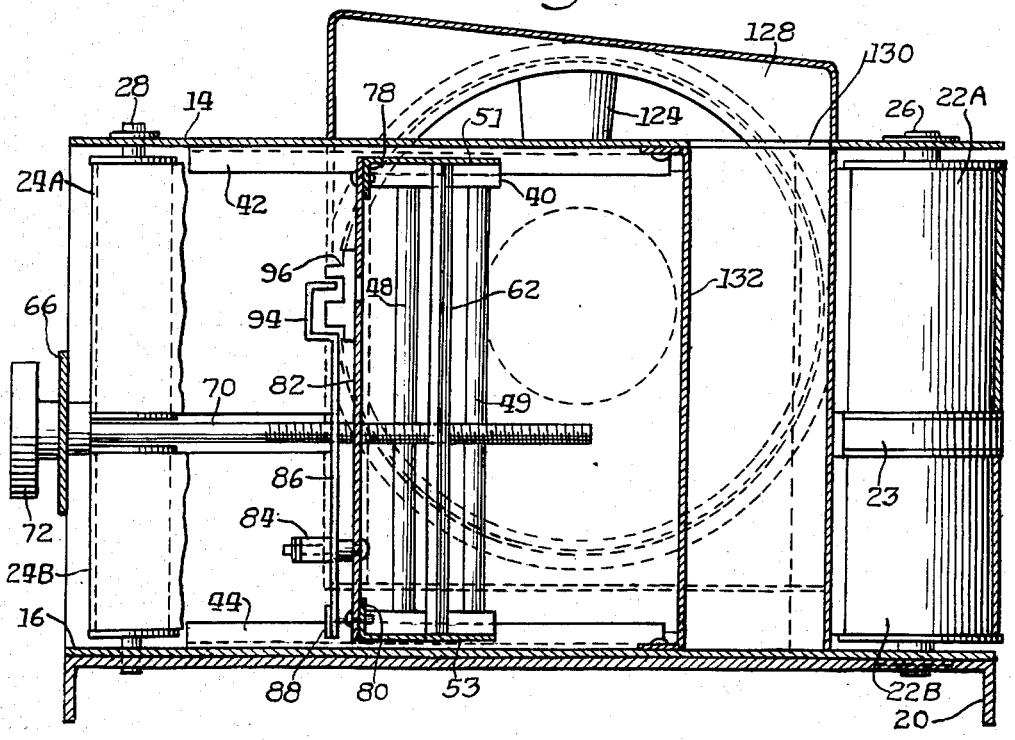
FIG. 3 is a cut-away elevation view of the sheet feeding apparatus taken along line 3—3 of FIG. 2, showing the document sensing switch mechanism which automatically controls the pressure on the web applied by the stack of sheets being advanced towards the web.

Carriage 40 includes a pair of flanges 78, 80, to which a mounting bracket 82 is firmly attached (FIGS. 2, 3 and 5). Pivot pin 84 extends outward from the lower portion of bracket 82, and a sensor lever 86 is mounted for limited pivotal movement about pivot pin 84 (FIGS. 2, 5). Sensor lever 86 is weighted to pivot counterclockwise under the influence of gravity (as viewed in FIG. 5). A portion of sensor lever 86 extends below pivot pin 84, and terminates in wand element 88, which is adjustably mounted to sensor lever 86 by means of screw 90 and slot 92. The forward portion of wand 88 is adapted to abut the sheets 77 as they are vertically arrayed on platform 20 (FIG. 5). The portion of sensor lever 86 which extends above pivot 84 is counter-balanced to rotate wand 88 counterclockwise (FIG. 5) when there is no sheet 77 adjacent the effective contact surface of webs 30, 32.

The extreme upper segment of sensor lever 86 includes a U-shaped portion 94 which alternately extends between or moves away from a photocell detector element 96 which is attached to mounting bracket 82. Photocell detector element 96 is connected as a switch in the mechanism which controls the movement of belts 76.

Referring next to FIGS. 1 and 2, a bracket 98 is pivotally attached to one side of platform 20, and includes a laterally extending flange portion 100. Shaft 102 is held between flange 100 and a corresponding flange (not shown) on the bottom of bracket 98. Nip roller 104 is driven by roller 23 while shaft 102 is rotated in the opposite direction, as indicated by arrow 114 (FIG. 1). Roller 104 and shaft 102 are coupled by constant spring force slip clutch 200. The bias for nip roller 104 is provided by a spring 106 mounted on threaded shaft 108, which in turn is mounted upon support bracket 110. A knob 112 is provided to rotate shaft 108 and thereby adjust the bias provided by spring 106 on nip roller 104 against roller 23 to accommodate sheet material of varying thicknesses.

Referring next to FIGS. 1, 2, 3 and 4, a suction chamber 120 is fixed to back frame portion 18 and includes a fan chamber 122 including a fan 124. Suction chamber 120 also includes a passage chamber 126 which opens to fan chamber 122, and which includes an upper portion 128 which extends across upper frame portion 14 (FIGS. 1, 4). A large aperture 130 is provided in upper frame portion 14 (FIG. 3), which opens into a plenum chamber 132 extending between upper frame portion 14 and lower frame portion 16. Plenum chamber 132 is located between the front and back runs of the portions of web 30, 32 which extend along plane 58, at the effective contact surface of the web. An opening 134 is provided in plenum chamber 132 to provide communication between the portion of perforations 34 in webs 30, 32 extending across opening 134 in plenum chamber 132 at any given time. As fan 124 is rotated, a relatively small suction force is developed in chambers 126 and 128, and transmitted to plenum chamber 132. This suction force is applied through openings 134 and through perforations 34 to the outer face of webs 30 and 32. Fan 124 creates a relatively low vacuum, but is quieter and cheaper than a vacuum pump. The adjustment of the effective contact surface of webs 30, 32 compensates for all vacuum loses in the fan.

The operation of the disclosed sheet feeding apparatus 10 is initiated by placing a stack of vertically extending sheet material 77 on platform 20 such that the bottom of the sheets 77 are resting on belts 76. A support block (not shown) may be placed in abutment with the sheet furtherest from the webs 30, 32 to maintain the sheets 77 in a vertical position. The block will also be sitting on belts 76, and will advance towards web 30, 32 as belts 76 are rotated.

Sheets 77 may comprise any type of document, such as a sheet of paper, an envelope, or the like. The sheets can be of any length, although it is contemplated that all sheets in a single stack be of a uniform length. As will be explained, the present invention can be adjusted to feed sheets 77 of varying lengths, however economics of operation dictate that these adjustments not be made during the handling of a single stack of sheet material. Sheets 77 of varying heights and thicknesses can also be accommodated by the present apparatus.

Prior to initiating the operation of the sheet feeding apparatus 10, certain adjustments are required based on the length and thickness of each sheet to be fed. First, the length of the portion of webs 30, 32 extending in plane 58 to provide the effective contact surface is established. A primary objective of the present invention to prevent the corners of sheet material 77 from becoming caught in perforations 34 of web 30, 32. Therefore, the position of carriage 40 is set such that the trailing, or left edge of each piece of sheet material 77 extends beyond the effective contact surface of the web as viewed in FIG. 1. Carriage 40 is therefore positioned such that the distance between roller elements 22 and 50 are slightly less than the length of sheet material 77. In this way, the left corners of sheet material 77 do not come into contact with the perforations 34 in webs 30, 32 until the webs 30, 32 have already begun transporting the sheet material from the stack. The positioning of carriage 40 is accomplished by rotating knob 72, which in turn rotates threaded shaft 70 causing carriage 40 to move in a lateral direction. As the distance between rollers 22 and 50 is changed by movement of carriage 40, the effective contact surface of webs 30, 32 is modified.

To commence operation, sheets 77 are placed on platform 20 where they also are supported by belts 76. Sensor lever 86 is balanced to rotate under the influence of gravity in a counter-clockwise direction (FIG. 5), whereby U-shaped portion 94 is pivoted away from photocell detector element 96. This causes photocell detector element 96 to actuate the driving means controlling rollers 79 and belts 76, thereby driving belts 76 such that sheets 77 are moved towards engagement with the effective contact surface of webs 30, 32. As the first sheet 77A in the stack approaches the effective contact surface of belts 30, 32, wand 88 is forced to the left by the first sheet in the stack, as viewed in FIG. 5, thereby rotating sensor lever 86 in a clockwise direction and causing U-shaped portion 94 to intercept photocell detector element 96. This stops the movement of belts 76.

Roller 22 is next actuated to drive webs 30, 32 in the direction indicated by arrow 140 in FIG. 1. As the feeding operation progresses, the first several sheets 77A in the stack will be removed from the stack by webs 30, 32, and wand 88 subsequently moves back to the right (FIG. 5) causing sensor lever 86 to again rotate counter clockwise under the influence of gravity. U-shaped element 94 will them move away from photocell detector element 96, and belts 76 will again be actuated. The stack of sheets 77 then advances until wand 88 again detects the presence of the first sheet 77 A in the stack and stops the rotation of belts 76 as described above. In this manner, the proper pressure applied by the stack of sheets 77 against webs 30, 32 is automatically maintained.

The rotation of fan 124 creates a relatively small suction force in chambers 122, 126 and 128. This suction force is transferred through aperture 130, into plenum chamber 132, and is then applied through opening 134 and through perforations 34 to the effective contact surface of webs 30, 32 as the webs pass over plenum chamber 132. This suction force causes the first sheet 77A in the stack to adhere to the effective contact surface of webs 30, 32, and to be transported in the direction indicated by arrow 140 between roller 23 and nip roller 104, and into the processing apparatus with which the sheet feeding device 10 is associated. Each sheet 77 in the stack is subsequently removed from the stack and fed laterally in the same manner as described above.

Each sheet 77 as it is fed to the right (FIG. 1) passes between roller 23 and reversely driven nip roller 104. As viewed in FIG. 1, both rollers 23 and 104 are driven in a counter-clockwise direction. The force of spring 106 is regulated whereby only slight pressure is applied by nip roller 104 against roller 23. As a single sheet 77 passes between rollers 23 and 104, the suction force overcomes the affect of nip roller 104 and the sheet is passed to the processing apparatus from the feeder 10. However, if more than one sheet 77 is accidentally advanced by webs 30, 32, nip roller 104 will reject all but the first sheet by holding additional sheets 77 in the stack until they are engaged by webs 30, 32.

The foregoing detailed description has been given for clearness of understanding only and no unnecessary limitations are to be understood therefrom. Modifications of the present invention may be made by those skilled in the art without departing from the spirit of the invention.

We claim:

1. In a sheet feeding apparatus for feeding vertically disposed sheet material from a horizontally extending stack comprising a platform adapted to support a stack of sheet material, vertically extending frame means disposed at one end of said platform, first and second roller means vertically supported in spaced relation by said frame means, endless web means extending around and driven by said first and second roller means, said web means including a plurality of perforations therein and having one run facing said platform, said one run providing an effective contact surface to engage the first article in said stack of sheet material whereby said first article is transported from said stack of sheet material as said endless web is driven, and adjusting means associated with said frame to vary the effective contact surface of said endless web means by driving said run of said endless web means facing said platform in two spaced apart planes, the effective contact surface of said web means being adjusted by varying the length of said planes by said adjusting means, whereby the effective contact surface of the web is adjusted to prevent corners of the sheet material from becoming caught by the perforations in said web.

2. The sheet feeding apparatus of claim 1 wherein:

said platform includes means for supporting said stack of sheet material and advancing said sheet material towards said effective contact surface of said endless web means.

3. The sheet feeding apparatus of claim 1 including means disposed in said platform for supporting said stack of sheet material, drive means connected to said support means to advance said stack of sheet material towards the effective contact surface of said endless web means, and sensing means adjacent said effective contact surface of said endless web means to detect the presence or absence of the first article of said stack against said effective contact surface, and control means operably connected between said sensing means and said support means to automatically control the advance of said stack of sheet material towards said effective contact surface.

4. The sheet feeding apparatus of claim 3 wherein said sensing means includes wand means pivotally connected to said adjusting means, said wand means biased by the force of gravity to pivot in one direction towards said stack of sheet material when said stack is not bearing tightly against said effective contact surface, and to pivot in the opposite direction under the influence of the first article of said stack of sheet material when the proper pressure between the stack of sheet material and the effective contact surface has been attained, said wand means adapted to actuate said control means to advance said stack of sheet material towards said effective contact surface when said wand pivots in said one direction, and to halt said advance of said stack of sheet material when said wand pivots in said opposite direction.

5. In a sheet feeding apparatus for feeding vertically disposed sheet material from a horizontally extending stack comprising a platform adapted to support a stack of sheet material, vertically extending frame means disposed at one end of said platform, first and second roller means vertically supported in spaced relation by said frame means, endless web means extending around and driven by said first and second roller means, said web means including a plurality of perforations therein and having one run facing said platform, said one run providing an effective contact surface to engage the first article in said stack of sheet material whereby said first article is transported from said stack of sheet material as said endless web is driven, adjusting means associated with said frame to vary the effective contact surface of said endless web means by driving said run of said endless web means facing said platform in two spaced apart planes, the effective contact surface of said web means being adjustable by varying the length of said planes by said adjusting means, whereby the effective contact surface of the web is adjusted to prevent corners of the sheet material from becoming caught by the perforations in said web, means disposed in said platform for supporting said stack of sheet material, drive means connected to said support means to advance said stack of sheet material towards the effective contact surface of said endless web means, and sensing means adjacent said effective contact surface of said endless web means to detect the presence or absence of the first article of said stack against said effective contact surface, control means operably connected between said sensing means and said support means to automatically control the advance of said stack of sheet material towards said effective contact surface, said sensing means including wand means pivotally connected to said adjusting means, said wand means biased by the force of gravity to pivot in one direction towards said stack of sheet material when said stack is not bearing tightly against said effective contact surface, and to pivot in the opposite direction under the influence of the first article of said stack of sheet material when the proper pressure between the stack of sheet material and the effective contact surface has been attained, said wand means adapted to actuate said control means to advance said stack of sheet material towards said effective contact surface when said wand pivots in said one direction, and to halt said advance of said stack of sheet material when said wand pivots in said opposite direction, said control means including a photoelectric cell switch mechanism operably connected to said drive means, said sensing means including a portion thereof adapted to actuate said photoelectric cell switch mechanism and said drive means when said wand means is pivoted in said first direction.

6. In a sheet feeding apparatus for feeding vertically disposed sheet material from a horizontaaly extending stack comprising a platform adapted to support a stack of sheet material, vertically extending frame means disposed at one end of said platform, first and second roller means vertically supported in spaced relation by said frame means, endless web means extending around and driven by said first and second roller means, said web means including a plurality of perforations therein and having one run facing said platform, said one run providing an effective contact surface to engage the first article in said stack of sheet material whereby said first article is transported from said stack of sheet material as said endless web is driven, adjusting means associated with said frame to vary the effective contact surface of said endless web means, whereby the effective contact surface of the web is adjusted to prevent corners of the sheet material from becoming caught by the perforations in said web, said adjusting means including carriage means mounted for longitudinal movement within said frame means between said first and second rollers, third and fourth rollers mounted on said carriage means, said endless web means extending between said third and fourth rollers whereby the effective contact surface of said endless web extends in a first plane adjacent said stack of sheet material, and the remaining portion of said endless web facing said platform extends in a second plane at a distance from said stack of sheet material, whereby the first article in said stack of sheet material contacts only the effective contact surface of said endless web means; and whereby said adjusting means includes means to adjust the position of said carriage means relative to said frame to vary the length of said effective contact surface.

7. The sheet feeding apparatus of claim 6 wherein said frame means includes a pair of opposed track elements, said carriage means being mounted for movement between said track means, said means to adjust the position of said carriage means including threaded shaft means extending between said frame and said carriage means, said threaded shaft means mating with an internally threaded aperture in said carriage means, whereby rotation of said threaded shaft means produces movement of said carriage in said track means.

8. The sheet feeding apparatus of claim 1 including a source of suction located between said first and second rollers and beneath said effective contact surface of said endless web means, whereby a suction force is applied through said perforations to said effective contact surface of said endless web means to enhance contact between said effective contact surface and the first article in said stack of sheet material.

9. The sheet feeding apparatus of claim 8 wherein said suction means includes a first chamber fixed to said frame, a fan disposed in said first chamber to create a suction force in said first chamber, a plenum chamber mounted in said frame and disposed between said first and second rollers and directly beneath said effective contact surface of said endless web means, said plenum chamber having an opening in contact with said first chamber whereby operation of said fan creates a suction force in said plenum chamber, said plenum chamber having an opening therein immediately adjacent said perforations in said endless web means, whereby said suction force is applied to said effective contact surface of said endless belt means through said plenum chamber.

10. A sheet feeding apparatus for feeding vertically disposed sheet material from a horizontally extending stack comprising: platform means extending horizontally and supporting said stack of sheet material, vertically extending frame means disposed at one end of said platform, endless web means extending around and driven by first and second roller means rotatably mounted in spaced relation in said frame means, said endless web means including a plurality of perforations therein and having an effective contact surface adapted to engage the first article in said stack of sheet material and to transport said first article from said stack of sheet material when said endless web is driven, adjusting means associated with said frame to vary the effective contact surface of said endless web means, said platform including belt means to support and advance said sheet material into contact with said effective contact surface of said endless web means, control means to selectively actuate said belt means, sensing means adapted to detect the presence or absence of said first article of said stack of sheet material adjacent said effective contact surface, said sensing means including wand means pivotally connected to said adjusting means, said wand means biased by the force of gravity to pivot in one direction towards said stack of said material when said stack is not bearing tightly against said effective contact surface of said endless web means, and to pivot in the opposite direction under the influence of the first article of said stack of said material when said stack is bearing against said effective contact surface, said wand including a portion thereof which alternately actuates a photoelectric cell switch connected to drive means associated with said belt means to drive said belt means when said wand pivots towards said stack of sheet material.

11. A sheet feeding apparatus for feeding vertically disposed sheet material from a horizontally extending stack comprising a platform extending horizontally and adapted to support said stack of sheet material, frame means fixed to one end of said platform, endless web means extending around and driven by first and second roller means mounted for rotation in said frame means, said endless web means including perforations therein and having an effective contact surface for engaging and transporting the first article in said stack of sheet material, carriage means mounted to said frame means for longitudinal movement relative to said frame means between said first and second roller means, third and fourth roller means mounted on said carriage means, said endless web means extending in a first plane from said first roller to said third roller, then extending between said third and fourth roller, and extending in a second plane between said fourth and second rollers, wherein said effective contact surface comprises the portion of said endless web extending between said first and third roller, adjusting means connected between said frame means and said carriage means to move said carriage means relative to said frame means and vary the length of said effective contact surface of said endless web means, whereby the effective contact surface of the web is adjusted to prevent corners of the sheet material from being caught by the perforations in said web.

12. The sheet feeding apparatus of claim 11 including a vacuum source disposed beneath said effective contact surface of said endless web, whereby said vacuum source provides a suction force through said perforations at said effective contact surface to firmly adhere the first article in said stack of sheet material to said effective contact surface of said endless web means.

13. The sheet feeding apparatus of claim 11 including a plurality of belt means disposed in the base of said platform, said belt means supporting said stack of sheet material, drive means connected to said belt means to advance said stack of sheet material towards said effective contact surface of said web means when actuated, sheet material sensing means operably connected to said carriage means to detect the presence or absence of the first article of said stack of sheet material against said effective contact area of said endless web means, said sensing means operably connected to said drive means for said belt means whereby said belt means are actuated to advance said stack of sheet material towards said effective contact surface when said sensing means detects the absence of said first article of said stack of sheet material adjacent said effective contact area of said endless web means.

* * * * *